US005259346A

United States Patent [19]

Mills

[11] Patent Number: 5,259,346

[45] Date of Patent: Nov. 9, 1993

[54] ROCKER ARM OF THE CAM-FOLLOWER TYPE FOR OPERATING TWO VALVES

[75] Inventor: Jesse V. Mills, Toledo, Ohio

[73] Assignee: Henley Manufacturing Holding Company, Inc., Hampton, N.H.

[21] Appl. No.: 972,427

[22] Filed: Nov. 5, 1992

[51] Int. Cl.[5] ..... F01L 1/18

[52] U.S. Cl. ..... 123/90.39; 123/90.4; 74/519; 74/559

[58] Field of Search ..... 123/90.39, 90.4, 90.41, 123/90.42, 90.43, 90.44, 90.27; 74/519, 559

[56] References Cited

U.S. PATENT DOCUMENTS

| | | | |
|---|---|---|---|
| 4,697,473 | 10/1987 | Patel | 123/90.39 |
| 4,825,717 | 5/1989 | Mills | 123/90.39 |
| 4,825,822 | 5/1989 | Muranaka et al. | 123/90.4 |
| 4,913,104 | 4/1990 | Mills | 123/90.40 |
| 4,979,475 | 12/1990 | Mills | 123/90.39 |
| 4,995,281 | 2/1991 | Allor et al. | 123/90.44 |
| 5,016,582 | 5/1991 | Mills | 123/90.39 |
| 5,038,732 | 8/1991 | Matayoshi et al. | 123/90.4 |
| 5,048,475 | 9/1991 | Mills | 123/90.39 |

*Primary Examiner*—Willis R. Wolfe
*Assistant Examiner*—Weilun Lo
*Attorney, Agent, or Firm*—Allen D. Gutchess, Jr.

[57] ABSTRACT

A rocker arm of the cam-follower type simultaneously operates two valves of a cylinder of an internal combustion engine. The rocker arm includes an intermediate portion and two end portions. The intermediate portion has upwardly extending side walls and end walls forming a large generally rectangular opening at the top edges thereof. The side walls have aligned holes carrying an axle on which is rotatably mounted a roller which contacts an overhead cam. One end portion of the rocker arm has a downwardly-facing recess to engage an upper end of a lifter post. The other end portion of the rocker arm has a long, narrow web with downwardly-facing pads near the ends thereof and in predetermined, spaced relationship. The pads engage upper ends of two valve stems for simultaneously operating valves to which the stems are connected.

11 Claims, 2 Drawing Sheets

ROCKER ARM OF THE CAM-FOLLOWER TYPE FOR OPERATING TWO VALVES

This invention relates to a rocker arm of the cam-follower type for simultaneously operating two valves of a cylinder of an internal combustion engine.

Internal combustion engines with cylinders having multiple valves are becoming more commonplace. Such engines have at least two intake valves and at least two exhaust valves for each cylinder. One type of rocker arm for operating two valves is shown in my U.S. Pat. No. 4,913,104, issued Apr. 3, 1990.

A rocker arm of the cam-follower type according to the present invention is capable of simultaneously operating two intake valves or two exhaust valves of a cylinder. The rocker arm has a one-piece metal body made by cold-forming operations, including stamping, extruding, coining, and back-packing. The metal body of the rocker arm is of generally inverted U-shaped cross section throughout much of its length. The rocker arm includes an intermediate portion and two end portions. The intermediate portion has two upwardly-extending side walls with a large generally rectangular opening at the top and two end walls extending upwardly thereto. Flat webs extend outwardly from the lower edges of the side walls and have downwardly-extending stiffening flanges.

A first end portion of the body has a wide top, flat wall which is structurally integral with an end wall of the intermediate portion of the rocker arm and has short stiffening flanges extending downwardly from edges thereof. A central portion of the top wall of the first end portion has a downwardly-facing recess therein to receive a rounded end of a lifter post.

The second end portion of the rocker arm body has a long but narrow web which is structurally integral with an end wall of the intermediate portion of the body and extends at least to the upright side walls of the intermediate portion. Two projections extend outwardly from the body at the ends of the web and near each is a lower, rounded surface forming a pad to engage an upper end of a valve stem.

The side walls of the intermediate portion of the body have aligned holes therein with an axle received therethrough and a roller rotatably mounted thereon for engaging an overhead cam through the rectangular opening.

It is, therefore, a principal object of the invention to provide a rocker arm of the cam-follower type which is capable of simultaneously operating two valves of a cylinder of an internal combustion engine.

Another object of the invention is to provide a rocker arm of the cam-follower type having a single cam-contacting roller and having means for engaging ends of two valve stems.

Many other objects and advantages of the invention will be apparent from the following detailed description of a preferred embodiment thereof, reference being made to the accompanying drawings, in which.

Figure 1:
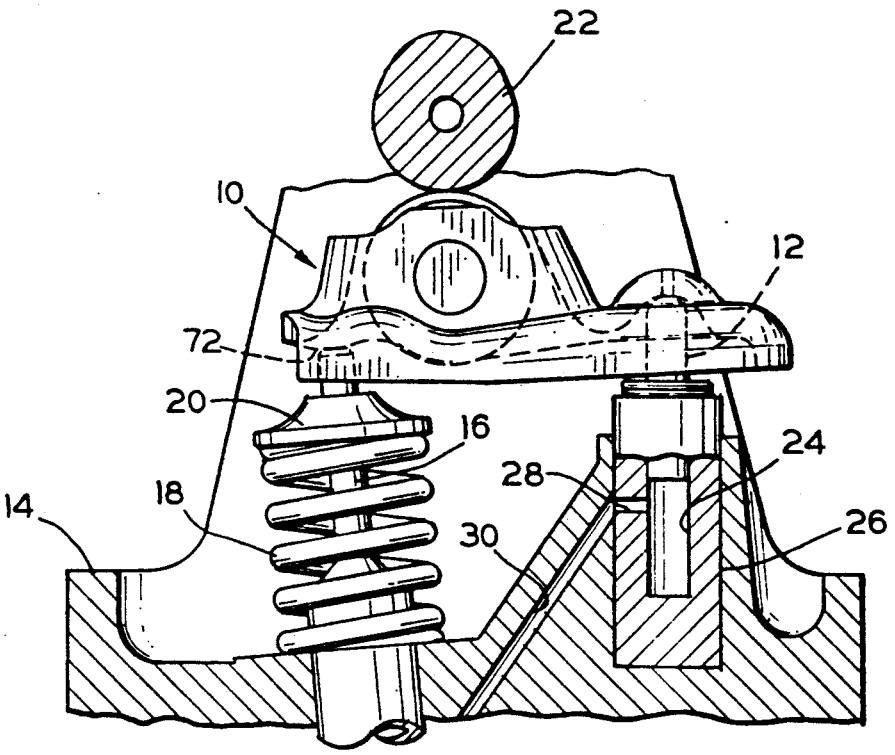
FIG. 1 is a somewhat schematic view in cross section, with parts in elevation, of valve-actuating mechanism including a rocker arm in accordance with the invention.
Figure 2:
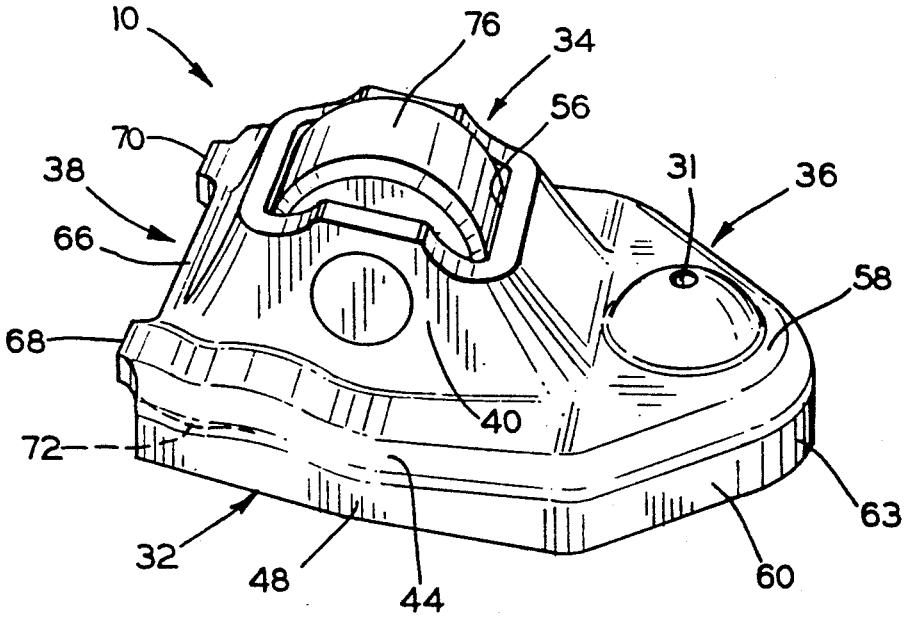
FIG. 2 is a view in perspective of the rocker arm of FIG. 1.
Figure 3:
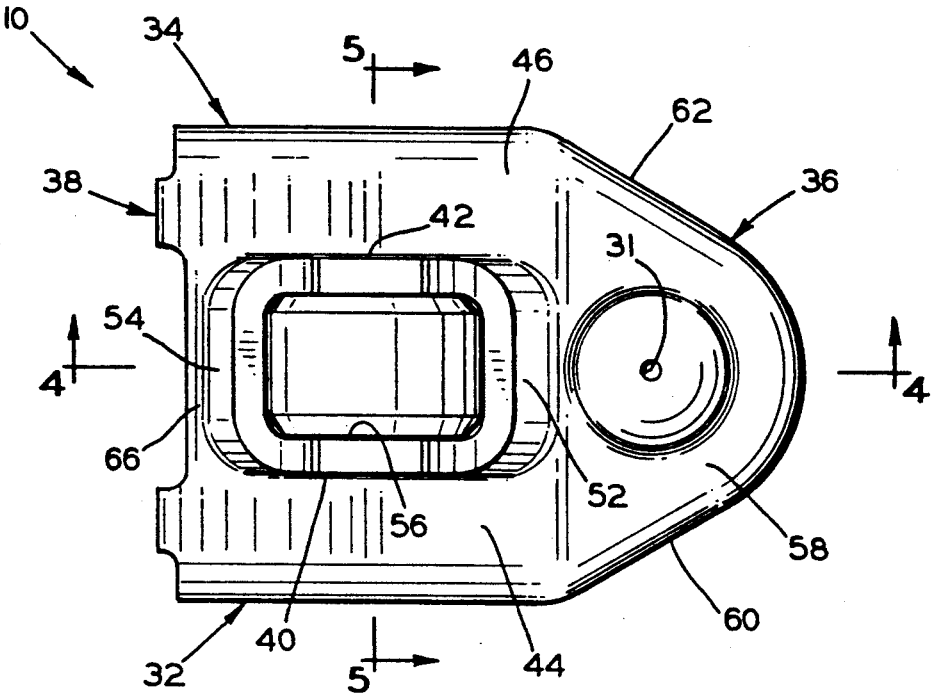
FIG. 3 is a top view of the rocker arm of FIG. 2.
Figure 4:
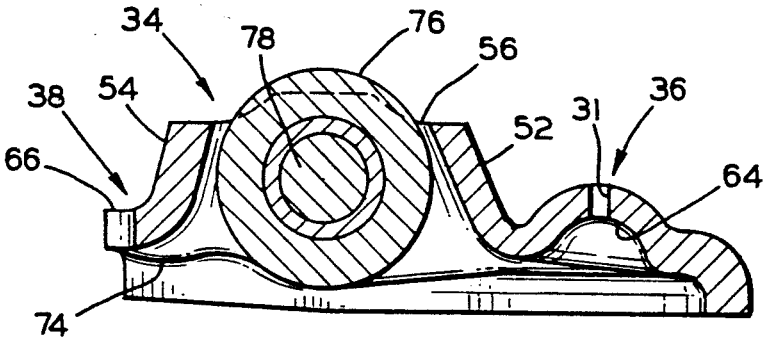
FIG. 4 is a view in longitudinal cross section taken along the lines 4—4 of FIG. 3.
Figure 5:
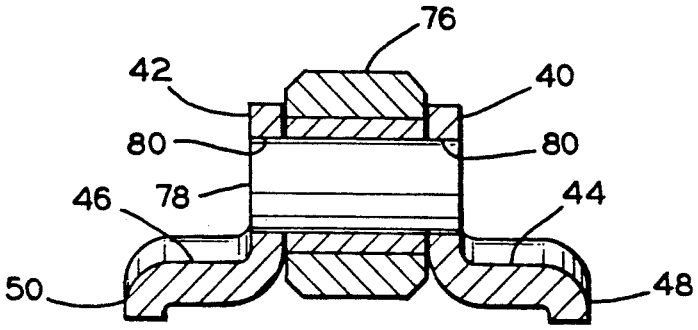
FIG. 5 is a view in transverse cross section taken along the line 5—5 of FIG. 3.

Referring particularly to FIG. 1, a rocker arm of the cam-follower type is indicated at 10 and has one end portion received on a rocker arm fulcrum or lifter post 12 extending upwardly from a cylinder head 14 of an internal combustion engine. A second end portion of the rocker arm engages upper ends of valve stems 16. The second valve stem is directly behind the one shown and is not visible. The valve stems extend upwardly from the cylinder head through coiled compression springs 18 located therearound and which are seated against the cylinder head and against retainer rings 20 mounted on the valve stems 16. An overhead cam 22 engages an intermediate portion of the rocker arm 10 to cause valves (not shown) located at the lower ends of the valve stems 16 to open and close as the stems are moved longitudinally by the rocker arm 10 as it is caused to pivot by the cam.

The lifter post 12 is slidably carried in a chamber 24 of a cylinder 26. The post is urged upwardly by oil under pressure in the chamber 24. The oil is supplied through a small port 28 from a supply passage 30. The post 12 can yield somewhat when the cam rotates, with the post moving downwardly slightly at the high lobe of the cam 22 to provide a zero lash adjustment for the rocker arm. The port is of a size to provide controlled leakage of the oil from the chamber 24 to control the oil pressure therein. Oil can also be supplied from the passage 30 to a passage (not shown) in the lifter post 12 and up to an oil hole 31 in the rocker arm 10 for lubricating purposes.

Referring more particularly to FIGS. 2-5, the rocker arm 10 includes a one-piece, cold-formed metal body 32 which is preferably made by cold-forming operations, including stamping, extruding, coining, and back-packing. The rocker arm body includes an intermediate portion 34 which engages the cam 22, a first end portion 36 which engages the lifter post 12, and a second end portion 38 which engages the two valve stems 16.

The intermediate portion 34 of the rocker arm body includes upright side walls 40 and 42 extending upwardly from flat walls or webs 44 and 46. Short straight stiffening flanges 48 and 50 extend downwardly therefrom and are structurally integral with outer edges of the webs 44 and 46. The intermediate portion 34 has end walls 52 and 54 extending upwardly. The intermediate portion also has a large, generally rectangular opening 56 formed at the upper edges of the walls 40, 42, and 52, 54.

The first end portion of the rocker arm body 34 has a wide flat top wall 58 which is structurally integral and blends in with the webs 44 and 46 of the intermediate portion 34. Two slanted stiffening flanges 60 and 62 extend downwardly from the flat wall 58 and are connected by a curved nose flange 63 which is structurally integral therewith. A rounded recess 64 is formed in the top flat wall 58 and faces downwardly to receive the upper end of the lifter post 12 on which the rocker arm 10 pivots.

The second portion 38 of the rocker arm body has a long, narrow stiffening web 66 with projections 68 and 70 extending outwardly from ends thereof. If desired, the web 66 can have a downwardly-extending flange for added stiffness. Rounded surfaces 72 and 74 form downwardly-facing pads at the second portion 38 to engage the upper ends of the valve stems 16. These pads are formed beyond the ends of the web 66 and near the projections 68 and 70. The pads are also located under the webs 44 and 46 near the ends of the downwardly-extending flanges 48 and 50.

The intermediate portion 34 of the rocker arm 10 rotatably carries a cam-contacting roller 76 which is exposed at the opening 56 and contacts the overhead cam 22 to cause the rocker arm to pivot on the post 12 when the cam 22 rotates. The use of the roller minimizes friction between the cam and the rocker arm which reduces loads and results in better fuel economy or higher performance, as well as reduced wear. The roller 76 is rotatably mounted on an axle 78 which extends through two aligned circular holes 80 in the side walls 40 and 42. The outer ends of the holes can have chamfers to receive flared ends of the axle to hold the axle in position, as is known in the art.

From the above, it will be seen that the single rocker arm 10 is all that is needed to operate two valves. This results in lesser weight than if separate rocker arms were used. Also, one less roller and one less cam lobe are required which reduces costs and results in fewer moving parts and potentially less maintenance problems. Further, space is saved in a direction longitudinally of the engine which is often of critical importance. With one less roller for the two valves, friction can also be reduced.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. A rocker arm of the cam-follower type for simultaneously operating two valves of a cylinder of an internal combustion engine, said rocker arm comprising a one-piece, cold-formed, metal body having an intermediate portion, a first end portion, and a second end portion, said intermediate portion having two upright side walls and two end walls forming a large upper opening, two flat webs structurally integral with lower portions of said upright side walls and extending outwardly therefrom, straight stiffening flanges extending downwardly from outer edge portions of said webs, said upright side walls having aligned openings, an axle received in said aligned openings, and a roller rotatably mounted on said axle and exposed at said large opening, said first end portion of said body having a flat wall extending outwardly beyond one of said end walls and being functionally integral with said webs, stiffening flanges extending around edges of said flat wall, a central portion of said flat wall having a downwardly-facing recess for engaging an upper end of a lifter post, said second end portion of said rocker arm body having a long narrow web structurally integral with the other of said end walls of said intermediate portion, said second end portion having outwardly-extending projections beyond the ends of said narrow web, and said body having downwardly-facing convex surfaces forming pads near said projections for engaging upper ends of valve stems of the valves.

2. A rocker arm according to claim 1 wherein said pads are located at end portions of said flat webs.

3. In combination, an internal combustion engine having a cylinder with at least two valves, a lifter post having an upwardly-extending rounded end located at one side of said valves, means for supporting said lifter post, a cam positioned near said valves and said lifter post and located thereabove, a rocker arm of the cam-follower type comprising a metal body having an intermediate portion and two end portions, said intermediate portion having upright side walls, said intermediate portion having two flat webs structurally integral with lower portions of said upright side walls and extending outwardly therefrom, straight stiffening flanges extending downwardly from outer edge portions of said flat webs, an axle extending between said side walls, and a roller rotatably mounted on said axle and positioned in contact with said cam, one of said end portions of said body having a downwardly-facing recess to engage an upper end of said lifter post, the other end portion of said body having downwardly-facing curved surfaces in predetermined spaced relationship forming pads to engage upper ends of valve stems of said valves, and said other end portion having outwardly-extending projections near said pads.

4. The combination according to claim 3 wherein said intermediate portion has two end walls forming a large upper opening with said two upright side walls.

5. The combination according to claim 3 wherein said one end portion has a flat wall in which said downwardly-facing recess is formed.

6. The combination according to claim 5 wherein stiffening flanges extend downwardly from edges of said flat wall.

7. A rocker arm of the cam-follower type for simultaneously operating two valves of a cylinder of an internal combustion engine, said rocker arm comprising a one-piece, metal body having an intermediate portion, a first end portion, and a second end portion, said intermediate portion having two aligned openings, said intermediate portion having two upright side walls in which said aligned openings are located, said intermediate portion having two flat webs structurally integral with lower portions of said upright side walls and extending outwardly therefrom, and stiffening flanges extending downwardly from outer edge portions of said flat webs, an axle received in said openings, and a roller rotatably mounted on said axle, said first end portion of said body having a downwardly-facing recess for engaging an upper end of a lifter post, said second end portion of said body having a long web, and said body having downwardly-facing surfaces forming pads near ends of said long web for engaging upper ends of valve stems of the valves.

8. A rocker arm according to claim 7 wherein said second end portion has outwardly-extending projections beyond the ends of said long web.

9. A rocker arm according to claim 7 wherein said intermediate portion has two ends walls forming a large upper opening with said two upright side walls.

10. A rocker arm according to claim 7 wherein said first end portion has a flat wall in which said downwardly-facing recess is formed.

11. A rocker arm according to claim 10 wherein stiffening flanges extend downwardly from edges of said flat wall.

* * * * *